US009541246B2

(12) United States Patent
Ruud et al.

(10) Patent No.: US 9,541,246 B2
(45) Date of Patent: Jan. 10, 2017

(54) AERODYNAMIC LED LIGHT FIXTURE

(71) Applicant: Cree, Inc., Durham, NC (US)

(72) Inventors: Alan J. Ruud, Racine, WI (US); Kurt S. Wilcox, Libertyville, IL (US); Steven R. Walczak, Kenosha, WI (US)

(73) Assignee: Cree, Inc., Durham, NC (US)

( * ) Notice: Subject to any disclaimer, the term of this patent is extended or adjusted under 35 U.S.C. 154(b) by 627 days.

(21) Appl. No.: 13/908,530

(22) Filed: Jun. 3, 2013

(65) Prior Publication Data

US 2014/0153242 A1 Jun. 5, 2014

Related U.S. Application Data

(63) Continuation of application No. 11/864,298, filed on Sep. 28, 2007, now abandoned, and a (Continued)

(51) Int. Cl.
*F21S 8/04* (2006.01)
*F21S 8/08* (2006.01)

(Continued)

(52) U.S. Cl.
CPC ..... *F21S 8/043* (2013.01); *F21K 9/00* (2013.01); *F21S 8/086* (2013.01); *F21V 15/01* (2013.01);

(Continued)

(58) Field of Classification Search
CPC ..... F21S 8/043; F21V 29/70; F21V 15/01; F21K 9/30

(Continued)

(56) References Cited

U.S. PATENT DOCUMENTS

D49,999 S 12/1916 Moritz
1,225,301 A 5/1917 Wolfe (Continued)

FOREIGN PATENT DOCUMENTS

CN ZL200420110545 12/2004
CN 1737418 A 8/2005

(Continued)

OTHER PUBLICATIONS

Tarricone, Paul. "Coming Soon to Broadway." www.jesna.org. Date: Feb. 2005.

(Continued)

*Primary Examiner* — Jong-Suk (James) Lee
*Assistant Examiner* — Leah S Macchiarolo
(74) *Attorney, Agent, or Firm* — Jansson Munger McKinley & Kirby Ltd.

(57) ABSTRACT

An LED light fixture having a light-emitting region and a perimetrical structure therearound. The light-emitting region includes at least one LED-array module supported by an LED heat sink open for air/water-flow. The perimetrical structure has first and second opposite substantially-aligned edge-adjacent portions each extending along the light-emitting region and meeting each other at a perimetrical edge. The first and second edge-adjacent portions converge toward each other at positions progressively closer to the perimetrical edge to form aerodynamic-drag-reducing cross-sectional profiles transverse to the fixture plane and extending in substantially all fixture-plane directions from the intersection of its two major principal axes.

20 Claims, 6 Drawing Sheets

Related U.S. Application Data continuation-in-part of application No. 13/834,525, filed on Mar. 15, 2013, now Pat. No. 9,039,223, which is a continuation of application No. 13/294,459, filed on Nov. 11, 2011, now Pat. No. 8,425,071, which is a continuation of application No. 12/629,986, filed on Dec. 3, 2009, now Pat. No. 8,070,306, which is a continuation of application No. 11/860,887, filed on Sep. 25, 2007, now Pat. No. 7,686,469, which is a continuation-in-part of application No. 11/541,908, filed on Sep. 30, 2006, now abandoned.

(51) Int. Cl.

| | |
|---|---|
| ***F21V 15/01*** | (2006.01) |
| ***F21K 99/00*** | (2016.01) |
| ***F21V 29/00*** | (2015.01) |
| ***F21V 29/70*** | (2015.01) |
| *F21W 131/103* | (2006.01) |
| *F21Y 101/00* | (2016.01) |

(52) U.S. Cl.

CPC ..... *F21V 29/004* (2013.01); *F21V 29/70* (2015.01); *F21W 2131/103* (2013.01); *F21Y 2101/00* (2013.01); *F21Y 2105/10* (2016.08); *F21Y 2115/10* (2016.08)

(58) Field of Classification Search

USPC ..... 362/431, 97, 544, 158, 240, 294, 373, 362/545

See application file for complete search history.

(56) References Cited

U.S. PATENT DOCUMENTS

| | | | |
|---|---|---|---|
| 2,254,790 | A | 9/1941 | Benton |
| 2,345,393 | A | 3/1944 | Heyermans |
| D155,488 | S | 5/1949 | Crockett |
| D162,639 | S | 3/1951 | Fiori |
| 2,612,600 | A | 9/1952 | Yonkers |
| D173,139 | S | 10/1954 | Black |
| 2,772,382 | A | 11/1956 | Escoffery |
| 2,886,699 | A | 5/1959 | Harling |
| 2,974,219 | A | 3/1961 | Husby |
| 3,071,683 | A | 1/1963 | Queale |
| 3,184,199 | A | 5/1965 | Clark |
| 3,233,094 | A | 2/1966 | Foulds |
| 3,478,200 | A | 11/1969 | Hewson |
| 3,489,384 | A | 1/1970 | Perbal |
| 3,652,047 | A | 3/1972 | Starr |
| 3,660,651 | A | 5/1972 | Miles, Jr. |
| 3,685,858 | A | 8/1972 | Wandler |
| 3,800,177 | A | 3/1974 | Russ |
| 3,819,929 | A | 6/1974 | Newman |
| 3,860,829 | A | 1/1975 | Fabbri |
| D234,712 | S | 4/1975 | Kennedy |
| 3,889,147 | A | 6/1975 | Groves |
| D246,203 | S | 10/1977 | Harris |
| 4,071,749 | A | 1/1978 | Balogh |
| 4,156,891 | A | 5/1979 | Roche |
| 4,167,033 | A | 9/1979 | Fletcher |
| 4,187,711 | A | 2/1980 | Lavochkin et al. |
| 4,203,488 | A | 5/1980 | Johnson et al. |
| 4,228,489 | A | 10/1980 | Martin |
| 4,235,285 | A | 11/1980 | Johnson et al. |
| 4,254,453 | A | 3/1981 | Mouyard |
| 4,264,946 | A | 4/1981 | Faux |
| 4,317,164 | A | 2/1982 | Karaktin |
| 4,332,363 | A | 6/1982 | Ware |
| D266,080 | S | 9/1982 | Asanuma |
| D266,081 | S | 9/1982 | Asanuma |
| D266,082 | S | 9/1982 | Asanuma |
| 4,398,239 | A | 8/1983 | de Vos |
| 4,410,933 | A | 10/1983 | Blake |
| 4,426,676 | A | 1/1984 | Taylor |
| 4,460,945 | A | 7/1984 | Chan et al. |
| D275,749 | S | 10/1984 | McCarthy |
| 4,494,177 | A | 1/1985 | Matthews |
| 4,508,163 | A | 4/1985 | McCarthy |
| 4,543,007 | A | 9/1985 | Quiogue |
| 4,551,793 | A | 11/1985 | Mellema |
| 4,552,206 | A | 11/1985 | Johnson et al. |
| D285,194 | S | 8/1986 | McCarthy |
| 4,679,118 | A | 7/1987 | Johnson et al. |
| 4,729,073 | A | 3/1988 | Klaus |
| 4,729,076 | A | 3/1988 | Masami et al. |
| D296,778 | S | 7/1988 | McCarthy |
| 4,787,019 | A | 11/1988 | Van Den Broeke |
| 4,793,581 | A | 12/1988 | Bilson |
| 4,875,057 | A | 10/1989 | Hediger et al. |
| 4,899,210 | A | 2/1990 | Lorenzetti et al. |
| 4,931,917 | A | 6/1990 | Scherf |
| 5,004,953 | A | 4/1991 | McDonald |
| D319,702 | S | 9/1991 | Kane |
| 5,069,538 | A | 12/1991 | Shust et al. |
| 5,119,174 | A | 6/1992 | Chen |
| 5,136,493 | A | 8/1992 | Straus |
| 5,172,755 | A | 12/1992 | Samarov |
| 5,226,723 | A | 7/1993 | Chen |
| D338,449 | S | 8/1993 | Sahyoun |
| 5,258,898 | A | 11/1993 | Thornton |
| 5,274,250 | A | 12/1993 | Miyake |
| 5,285,350 | A | 2/1994 | Villaume |
| 5,303,124 | A | 4/1994 | Wrobel |
| 5,304,735 | A | 4/1994 | Earl et al. |
| 5,357,414 | A | 10/1994 | Dane |
| D354,558 | S | 1/1995 | Marvin |
| 5,381,041 | A | 1/1995 | Harmon |
| 5,381,305 | A | 1/1995 | Harmon et al. |
| 5,384,940 | A | 1/1995 | Soule et al. |
| D355,722 | S | 2/1995 | Roos |
| 5,398,177 | A | 3/1995 | Harwood |
| 5,436,798 | A | 7/1995 | Wieland, Jr. |
| D361,317 | S | 8/1995 | Harmon et al. |
| D361,986 | S | 9/1995 | Harmon |
| 5,474,482 | A | 12/1995 | Davidson |
| 5,494,098 | A | 2/1996 | Morosas |
| 5,517,395 | A | 5/1996 | Weissman |
| 5,562,146 | A | 10/1996 | Harmon et al. |
| 5,576,933 | A | 11/1996 | Campanella et al. |
| D376,349 | S | 12/1996 | Campanella et al. |
| 5,581,442 | A | 12/1996 | Morosas |
| 5,586,004 | A | 12/1996 | Green et al. |
| 5,593,225 | A | 1/1997 | Safyan |
| 5,611,393 | A | 3/1997 | Vasconcelos et al. |
| 5,623,551 | A | 4/1997 | East |
| 5,633,564 | A | 5/1997 | Edwards |
| 5,660,461 | A | 8/1997 | Ignatius et al. |
| D384,040 | S | 9/1997 | Frerichs et al. |
| 5,676,455 | A | 10/1997 | Johnson |
| 5,711,890 | A | 1/1998 | Hawkins |
| D390,539 | S | 2/1998 | Campanella |
| D394,043 | S | 5/1998 | Campanella et al. |
| 5,771,155 | A | 6/1998 | Cook |
| 5,782,555 | A | 7/1998 | Hochstein |
| D397,468 | S | 8/1998 | Zeller |
| 5,796,154 | A | 8/1998 | Sano |
| 5,800,053 | A | 9/1998 | Shen |
| 5,833,358 | A | 11/1998 | Patik |
| 5,857,767 | A | 1/1999 | Hochstein |
| D407,381 | S | 3/1999 | Campanella |
| 5,894,882 | A | 4/1999 | Kikuchi et al. |
| 5,896,288 | A | 4/1999 | Lecheler |
| 5,909,062 | A | 6/1999 | Krietzman |
| 5,936,353 | A | 8/1999 | Triner et al. |
| 5,984,494 | A | 11/1999 | Chapman |
| 5,988,829 | A | 11/1999 | Holder |
| 6,011,299 | A | 1/2000 | Brench |
| 6,045,232 | A | 4/2000 | Buckmaster |
| 6,045,239 | A | 4/2000 | Waldmann |
| 6,045,240 | A | 4/2000 | Hochstein |
| 6,056,254 | A | 5/2000 | Albright |
| 6,155,701 | A | 12/2000 | Len |

(56) References Cited

U.S. PATENT DOCUMENTS

D442,313 S 5/2001 Wojkowiak
D442,565 S 5/2001 Chou et al.
D442,566 S 5/2001 Chou et al.
6,227,684 B1 5/2001 Wijbenga et al.
6,229,160 B1 5/2001 Krames et al.
D445,922 S 7/2001 Yasuoka
6,255,786 B1 7/2001 Yen
6,274,924 B1 8/2001 Carey et al.
D449,126 S 10/2001 Zeller
D450,306 S 11/2001 Lin et al.
6,323,063 B2 11/2001 Krames et al.
6,325,524 B1 12/2001 Weber
6,329,593 B1 12/2001 Yang
6,357,895 B1 3/2002 Kierulf
6,375,340 B1 4/2002 Biebl et al.
6,401,806 B1 6/2002 Lee et al.
6,414,343 B1 7/2002 Kondo
6,428,189 B1 8/2002 Hochstein
6,449,151 B1 9/2002 Chen
6,457,837 B1 10/2002 Steffensmeier
6,467,928 B2 10/2002 Crelin
D465,462 S 11/2002 Hsieh
6,481,874 B2 11/2002 Petroski
6,486,499 B1 11/2002 Krames et al.
6,498,355 B1 12/2002 Harrah et al.
6,501,103 B1 12/2002 Jory et al.
6,502,956 B1 1/2003 Wu
6,502,967 B2 1/2003 Mullen
D470,965 S 2/2003 Landefeld
6,517,218 B2 2/2003 Hochstein
6,521,914 B2 2/2003 Krames et al.
6,522,263 B2 2/2003 Jones
6,527,422 B1 3/2003 Hutchison
6,529,375 B2 3/2003 Miyahara
6,547,249 B2 4/2003 Collins, III et al.
6,554,451 B1 4/2003 Keuper
6,558,021 B2 5/2003 Wu et al.
6,565,238 B1 5/2003 Pyrtle
6,570,190 B2 5/2003 Krames et al.
6,578,986 B2 6/2003 Swaris et al.
6,612,717 B2 9/2003 Yen
6,614,103 B1 9/2003 Durocher et al.
D481,017 S 10/2003 Hsia et al.
6,630,736 B1 10/2003 Ignaut
6,635,911 B2 10/2003 Maruyama
6,635,941 B2 10/2003 Suda
D482,481 S 11/2003 Landefeld
6,641,284 B2 11/2003 Stopa et al.
6,648,496 B1 11/2003 Elghoroury et al.
6,657,862 B2 12/2003 Crocker et al.
6,666,567 B1 12/2003 Feldman et al.
6,676,279 B1 1/2004 Hubbell et al.
6,682,204 B2 1/2004 Mullally et al.
6,688,380 B2 2/2004 Lavochkin et al.
D488,248 S 4/2004 Toyoaki
6,720,566 B2 4/2004 Blandford
6,726,521 B2 4/2004 Peterson
6,730,940 B1 5/2004 Steranka
D493,151 S 7/2004 Lee
D494,549 S 8/2004 Lee
6,784,351 B2 8/2004 Hauptmann et al.
6,784,357 B1 * 8/2004 Wang ..... F21S 8/086 136/244
6,814,473 B2 11/2004 Chen
6,815,724 B2 11/2004 Dry
6,834,981 B2 12/2004 Nagai et al.
6,837,605 B2 1/2005 Reill
6,841,931 B2 1/2005 Takahashi et al.
6,851,531 B2 2/2005 Sasse
6,857,767 B2 2/2005 Matsui et al.
6,860,620 B2 3/2005 Kuan et al.
6,864,513 B2 3/2005 Lin et al.
6,871,993 B2 3/2005 Hecht
6,876,008 B2 4/2005 Bhat
6,885,035 B2 4/2005 Bhat et al.
D505,220 S 5/2005 Stekelenburg
6,893,941 B2 5/2005 Suda
6,914,261 B2 7/2005 Ho
RE38,767 E 8/2005 Wedell
6,932,495 B2 8/2005 Sloan et al.
6,934,153 B2 8/2005 Lee et al.
6,935,410 B2 8/2005 Lee et al.
6,942,361 B1 9/2005 Kishimura et al.
6,945,683 B2 9/2005 Gross et al.
6,957,905 B1 10/2005 Pritchard et al.
6,958,914 B2 10/2005 Hoss
6,959,996 B2 11/2005 Ip
6,969,946 B2 11/2005 Steranka
6,972,439 B1 12/2005 Kim
6,999,318 B2 2/2006 Newby
7,008,080 B2 3/2006 Bachl et al.
7,009,213 B2 3/2006 Camras
7,019,334 B2 3/2006 Yatsuda
7,036,961 B2 5/2006 Defouw et al.
7,045,965 B2 5/2006 Li et al.
7,055,987 B2 6/2006 Staufert
7,056,116 B2 6/2006 Scott et al.
7,063,451 B2 6/2006 Shen
7,078,258 B2 7/2006 Sakoh
7,080,932 B2 7/2006 Keuper
7,081,645 B2 7/2006 Chen et al.
D526,972 S 8/2006 Egawa et al.
7,090,370 B2 8/2006 Clark et al.
7,102,185 B2 9/2006 Nichols
7,114,830 B2 10/2006 Robertson et al.
7,141,825 B2 11/2006 Horio
7,153,004 B2 12/2006 Galli
7,165,870 B2 1/2007 McKenney
D536,816 S 2/2007 Mier-Langner
D536,817 S 2/2007 Mier-Langner
7,176,070 B2 2/2007 Lee
7,178,941 B2 2/2007 Roberge et al.
7,182,480 B2 2/2007 Kan
D537,972 S 3/2007 Mier-Langner
D537,973 S 3/2007 Mier-Langner
D538,459 S 3/2007 Rose
D538,961 S 3/2007 Mier-Langner
D539,460 S 3/2007 Mier-Langner
D539,956 S 4/2007 Rose
7,199,529 B2 4/2007 Vernon-Dier
D543,657 S 5/2007 Lehman
7,214,952 B2 5/2007 Klipstein et al.
7,234,844 B2 6/2007 Bolta et al.
7,237,936 B1 7/2007 Gibson
7,244,042 B1 7/2007 Bieberdorf
D550,885 S 9/2007 Crosby
D551,379 S 9/2007 Maxik
7,267,459 B2 9/2007 Matheson
7,269,009 B2 9/2007 Ryu et al.
7,273,987 B2 9/2007 Becker et al.
7,278,761 B2 10/2007 Kuan
7,281,818 B2 10/2007 You
7,288,796 B2 10/2007 Dry
7,303,301 B2 12/2007 Koren et al.
7,322,735 B1 1/2008 Caldani
D563,013 S 2/2008 Levine
7,329,030 B1 2/2008 Wang
7,329,033 B2 2/2008 Glovatsky et al.
D563,580 S 3/2008 Prazoff
D563,582 S 3/2008 Levine
D564,117 S 3/2008 Lippett
7,348,604 B2 3/2008 Matheson
D570,535 S 6/2008 Kinnune
D571,032 S 6/2008 Chen
D573,741 S 7/2008 Lou
D573,743 S 7/2008 Yan et al.
D576,330 S 9/2008 Ruud et al.
D577,455 S 9/2008 Zheng
D577,847 S 9/2008 Ruud et al.
7,434,959 B1 10/2008 Wang
7,434,964 B1 10/2008 Zheng
D580,082 S 11/2008 Zemar
D581,080 S 11/2008 Mier-Langner
7,461,952 B2 12/2008 Trenchardl

(56) References Cited

U.S. PATENT DOCUMENTS 7,488,090 B1 2/2009 Bucher et al.
7,488,093 B1 2/2009 Huang et al.
7,503,669 B2 3/2009 Rizkin et al.
7,513,639 B2 4/2009 Wang
7,530,711 B2 5/2009 Bang
7,534,009 B2 5/2009 Trojanowski et al.
7,543,953 B2 6/2009 Chapman
7,549,774 B2 6/2009 Tsai
7,566,147 B2 7/2009 Wilcox et al.
7,569,802 B1 8/2009 Mullins
7,572,027 B2 8/2009 Zampini, II et al.
7,575,354 B2 8/2009 Woodward
D599,494 S 9/2009 Levine
D599,940 S * 9/2009 Zheng ..... D26/71
D600,400 S 9/2009 Friedman
7,591,567 B2 9/2009 Wilcox
D603,077 S 10/2009 Kinnune
7,637,624 B2 12/2009 Chin
7,637,630 B2 12/2009 Wilcox
7,637,633 B2 12/2009 Wong
D608,927 S 1/2010 Hsu
7,651,245 B2 1/2010 Thomas
7,654,691 B2 2/2010 Liu
7,665,699 B2 2/2010 Oddsen
7,665,862 B2 2/2010 Villard
D612,527 S 3/2010 Espiau
7,679,096 B1 3/2010 Ruffin
7,686,469 B2 3/2010 Ruud et al.
7,703,939 B2 4/2010 Wilcox
7,744,236 B2 6/2010 Hsu
7,744,247 B2 6/2010 Zhang
D619,291 S 7/2010 Thevenot
7,758,211 B2 7/2010 Zheng
D621,988 S 8/2010 Zheng
7,771,087 B2 8/2010 Wilcox
7,794,116 B2 9/2010 Shuai
D626,264 S 10/2010 Liu
7,828,465 B2 11/2010 Roberge et al.
D630,790 S 1/2011 Josefowicz
D634,873 S 3/2011 Guercio
D634,874 S 3/2011 Yamada
D636,514 S 4/2011 Ruud
D636,920 S 4/2011 Boissevain
D638,566 S 5/2011 Goelz
7,938,558 B2 5/2011 Wilcox
7,952,262 B2 5/2011 Wilcox et al.
D641,908 S 7/2011 McKee
7,976,199 B2 7/2011 Berns
D645,601 S 9/2011 Bacon
8,021,026 B2 9/2011 Liu
D649,694 S 11/2011 Kong
8,057,078 B1 11/2011 Ko
8,061,869 B2 11/2011 Lo
8,067,778 B2 11/2011 Bae
8,070,306 B2 12/2011 Ruud et al.
8,092,042 B2 1/2012 Wilcox
8,092,049 B2 1/2012 Kinnune
8,104,933 B2 1/2012 Liu
D660,496 S 5/2012 Alkdag
8,267,541 B2 9/2012 Watanabe
D668,370 S 10/2012 Guercio
8,313,221 B2 11/2012 Hsu
8,313,222 B2 11/2012 Kinnune et al.
8,353,606 B2 1/2013 Jeong
8,382,387 B1 2/2013 Sandoval
D678,579 S 3/2013 Lee
8,393,764 B2 3/2013 Yao
D681,250 S 4/2013 Ruffalo
8,425,071 B2 4/2013 Ruud
8,425,086 B2 4/2013 Chen
D681,869 S 5/2013 Goelz
8,545,065 B2 10/2013 Kim
D694,452 S 11/2013 Goelz
8,622,584 B2 1/2014 Kinnune
8,925,884 B2 1/2015 Schultz
9,039,223 B2 5/2015 Rudd
2001/0046133 A1 11/2001 Ramer et al.
2002/0070386 A1 6/2002 Krames et al.
2002/0131275 A1 9/2002 Yamamoto et al.
2002/0171087 A1 11/2002 Krames et al.
2003/0048608 A1 3/2003 Crocker et al.
2003/0189829 A1 10/2003 Shimizu et al.
2004/0036629 A1 2/2004 Jones et al.
2004/0052077 A1 3/2004 Shih
2004/0095773 A1 5/2004 Gaskins et al.
2004/0156209 A1 8/2004 Ishida
2004/0161338 A1 8/2004 Hsieh
2004/0174651 A1 9/2004 Aisenbrey
2004/0175189 A1 9/2004 Weber-Rabsilber et al.
2004/0212291 A1 10/2004 Keuper
2004/0213016 A1 10/2004 Rice
2004/0222516 A1 11/2004 Lin et al.
2004/0240226 A1* 12/2004 Gross ..... F21S 48/215 362/544
2004/0251469 A1 12/2004 Yatsuda
2004/0257006 A1 12/2004 Beeman et al.
2004/0257808 A1 12/2004 Bjornson et al.
2004/0264195 A1 12/2004 Chang et al.
2005/0023545 A1 2/2005 Camras et al.
2005/0052378 A1 3/2005 Hacker
2005/0057939 A1 3/2005 Mizuyoshi
2005/0068765 A1 3/2005 Ertze Encinas et al.
2005/0072558 A1 4/2005 Whitney et al.
2005/0128752 A1 6/2005 Ewington
2005/0135093 A1 6/2005 Alexanderson et al.
2005/0174762 A1 8/2005 Fogerlie
2005/0190562 A1 9/2005 Keuper et al.
2005/0213328 A1 9/2005 Matheson
2005/0224826 A1 10/2005 Keuper et al.
2005/0258446 A1 11/2005 Raos
2005/0265035 A1 12/2005 Brass
2005/0274959 A1 12/2005 Kim et al.
2005/0281033 A1 12/2005 Coushaine et al.
2006/0018099 A1 1/2006 Chen
2006/0056169 A1 3/2006 Lodhie et al.
2006/0061967 A1 3/2006 Kim et al.
2006/0097385 A1 5/2006 Negley
2006/0105482 A1 5/2006 Alferink et al.
2006/0131757 A1 6/2006 Yu et al.
2006/0138645 A1 6/2006 Ng et al.
2006/0138951 A1 6/2006 Tain et al.
2006/0141851 A1 6/2006 Matsui et al.
2006/0146531 A1 7/2006 Reo et al.
2006/0158080 A1 7/2006 Nakano
2006/0175626 A1 8/2006 Wall, Jr.
2006/0176686 A1 8/2006 McVicker
2006/0181878 A1 8/2006 Burkholder
2006/0187671 A1 8/2006 Coushaine
2006/0193139 A1 8/2006 Sun
2006/0250803 A1 11/2006 Chen
2007/0019415 A1 1/2007 Leblanc et al.
2007/0070625 A1 3/2007 Bang
2007/0086196 A1 4/2007 Wong
2007/0097684 A1 5/2007 Obara
2007/0098334 A1 5/2007 Chen
2007/0115666 A1 5/2007 Thomas
2007/0159827 A1 7/2007 Huang
2007/0258214 A1 11/2007 Shen
2008/0002399 A1 1/2008 Villard et al.
2008/0019129 A1 1/2008 Wang
2008/0037239 A1 2/2008 Thomas et al.
2008/0043473 A1 2/2008 Matsui
2008/0043479 A1 2/2008 Wang
2008/0055908 A1 3/2008 Wu et al.
2008/0068799 A1 3/2008 Chan
2008/0080162 A1 4/2008 Wilcox et al.
2008/0080188 A1 4/2008 Wang
2008/0080189 A1 4/2008 Wang
2008/0080196 A1 4/2008 Ruud
2008/0089071 A1 4/2008 Wang
2008/0212324 A1 9/2008 Lin
2009/0034257 A1 2/2009 Liu et al.
2009/0034261 A1 2/2009 Grove
2009/0180281 A1 7/2009 Ashland

(56) References Cited

U.S. PATENT DOCUMENTS

| | | | |
|---|---|---|---|
| 2009/0244895 | A1 | 10/2009 | Chen |
| 2009/0251898 | A1 | 10/2009 | Kinnune |
| 2009/0268477 | A1* | 10/2009 | Zheng ..... F21V 29/004 362/373 |
| 2009/0296403 | A1 | 12/2009 | Zhang |
| 2010/0026158 | A1 | 2/2010 | Wu |
| 2010/0039013 | A1 | 2/2010 | Tsai |
| 2010/0046223 | A1 | 2/2010 | Li |
| 2010/0080004 | A1 | 4/2010 | Zhang |
| 2010/0097815 | A1 | 4/2010 | Song |
| 2010/0149809 | A1 | 6/2010 | Ruud |
| 2010/0195323 | A1 | 8/2010 | Schaefer |
| 2010/0238671 | A1 | 9/2010 | Catone |
| 2010/0296287 | A1 | 11/2010 | Huang |
| 2010/0314985 | A1 | 12/2010 | Premysler |
| 2011/0004157 | A1 | 1/2011 | Dewaele |
| 2011/0013397 | A1 | 1/2011 | Catone |
| 2011/0089830 | A1 | 4/2011 | Pickard |
| 2011/0095690 | A1 | 4/2011 | Sagal |
| 2011/0188233 | A1 | 8/2011 | Josefowicz |
| 2011/0222284 | A1 | 9/2011 | Kong |
| 2011/0299280 | A1 | 12/2011 | Maeers |
| 2011/0310603 | A1 | 12/2011 | Simons |
| 2012/0025711 | A1 | 2/2012 | Best |
| 2012/0057351 | A1 | 3/2012 | Wilcox |
| 2012/0099317 | A1 | 4/2012 | Liu |
| 2012/0099319 | A1 | 4/2012 | Liu |
| 2012/0113634 | A1 | 5/2012 | Wong |
| 2012/0162987 | A1 | 6/2012 | Liu |
| 2012/0218769 | A1 | 8/2012 | Van Horn |
| 2012/0281404 | A1 | 11/2012 | Wilcox |
| 2012/0307496 | A1 | 12/2012 | Phillips |
| 2013/0083522 | A1 | 4/2013 | Bowers |
| 2013/0250574 | A1 | 9/2013 | Moriyama |
| 2013/0301274 | A1 | 11/2013 | Anderson |
| 2013/0322068 | A1 | 12/2013 | Clark |
| 2013/0322070 | A1 | 12/2013 | Clark |
| 2014/0049961 | A1 | 2/2014 | Wilcox |
| 2014/0268870 | A1 | 9/2014 | Boomgaarden |
| 2015/0267908 | A1 | 9/2015 | Smith |

FOREIGN PATENT DOCUMENTS

| | | | |
|---|---|---|---|
| CN | 101093073 | | 12/2007 |
| CN | 101101102 | | 1/2008 |
| CN | 101101103 | | 1/2008 |
| CN | 101101104 | | 1/2008 |
| CN | 101101106 | | 1/2008 |
| CN | 101101107 | | 1/2008 |
| CN | 101105268 | | 1/2008 |
| CN | 101105278 | | 1/2008 |
| DE | 9417326 | | 2/1995 |
| DE | 10110835 | A1 | 3/2001 |
| DE | 202006015981 | U1 | 10/2006 |
| DE | 2020006010949 | U1 | 10/2006 |
| EP | 1431653 | A2 | 6/2004 |
| EP | 1760393 | | 3/2007 |
| EP | 1906081 | | 4/2008 |
| FR | 2818786 | A1 | 6/2002 |
| GB | 2201042 | A | 8/1988 |
| JP | 59229844 | A | 12/1984 |
| JP | 2000183406 | A | 6/2000 |
| JP | 2005109228 | | 4/2005 |
| JP | 2007134190 | | 5/2007 |
| KR | 20060001909 | A | 1/2006 |
| NL | 1026514 | | 6/2004 |
| WO | WO9833007 | A1 | 7/1998 |
| WO | WO9957945 | A1 | 11/1999 |
| WO | WO0125683 | A1 | 12/2001 |
| WO | WO0216826 | A1 | 2/2002 |
| WO | WO03089841 | A1 | 10/2003 |
| WO | WO2004079256 | A1 | 9/2004 |
| WO | WO2006049086 | A1 | 5/2006 |
| WO | WO2006060905 | A1 | 6/2006 |
| WO | WO2007000037 | A1 | 1/2007 |

OTHER PUBLICATIONS

Excerpt from www.ledsmagazine.com. "LED design wins New York city streetlight competition." Date: Dec. 2004.
"Professional Lighting Design." No. 40. Date: Nov./Dec. 2005.
The Lighting Journal. "LED Street Lighting." Date: Jul./Aug. 2006.
Excerpt from enLux Lighting. www.enluxled.com. "enLux 6K Series LED Outdoor Area Light." Date: undated.
Excerpt from enLux Lighting. www.enluxled.com. "enLux 6K Series LED Theatrical Area Light." Date: undated.
Excerpt from enLux Lighting. www.enluxled.com. "enLux 1K LED Light Bar Module." Date: undated.
Alpha One GmbH. "Falcon flood—LED." Date: undated.
Alpha One GmbH. "Savi Architectural LED Lighting" technical specification. Date: undated.
Excerpt from Supervision International website. www.svision.com. "SaVi SHO." Date: Copyright 2006.
Excerpt from Supervision International website. www.svision.com. "SaVi SHO" technical specification. Date: undated.
Leotek brochure. "LED Outdoor Luminaire & Light Fixtures." Date: undated.
In Reexamination of U.S. Pat. No. 8,070,306, PTO Action. Date: May 7, 2012.
In Reexamination of U.S. Pat. No. 8,070,306, response and supporting documents to May 7, 2012 PTO Action. Date: Jul. 9, 2012.
Images from Cooper Lighting's Motion for Leave. Date: 2004.
Images from Cooper Lighting's Motion for Leave. Date: 2005.
Images from Cooper Lighting's Motion for Leave. Date: 2006.
Future Lighting Solutions brochure. "The 6 Steps to LED Lighting Success." 6 pages. Date: undated.
Excerpt from Aavid Thermalloy (www.aavidthermalloy.com). "LED Light Sources." 1 page. Date: Copyright 2006.
Aavid Thermal Technologies, Inc. article. "How to Select a Heat Sink." 5 pages. Date: undated.
Excerpt from Mouser Electronics (www.mouser.com). Product List. 1 page. Date: Aug. 16, 2006.
Excerpt from Lumileds Future Electronics (www.lumiledsfuture.com). "Thermal Solutions." 1 page. Date: Jul. 14, 2006.
Excerpt from National Northeast Corporation brochure. "Miscellaneous Shape Heat Sinks." 2 pages. Date: undated.
Excerpt from Aavid Thermalloy (www.aavidthermalloy.com). Part Specification. 3 pages. Date: Copyright 2006.
Excerpt from Thelma-Flo brochure. 8 pages. Date: Copyright 2002.
Excerpt from Aavid Thermalloy (www.aavidthermalloy.com). "Product Offerings." 2 pages. Date: Copyright 2006.
Excerpt from ThermaFlo (www.thermaflow.com). "Bonded Fin Heat Sinks." 1 page. Date: Aug. 24, 2006.
Excerpt from ThermaFlo (www.thermaflow.com). "Folded Fin Heat Sinks." 2 pages. Date: Aug. 24, 2006.
Excerpt from ThermaFlo (www.thermaflow.com). "High Power Heat Sinks." 2 pages. Date: Aug. 24, 2006.
National Northwest Corporation brochure. "Flat Back Shape Heat Sinks III." 12 pages. Date: undated.
Excerpt from Wakefield Thermal Solutions (www.wakefield.com). "Thermal Extrusions." 1 page. Date: Aug. 16, 2006.
Wakefield Thermal Solutions brochure. "Quality Aluminum Extrusion and Fabrication." 4 pages. Date: undated.
Stanley Electric co., Ltd. "Stanley LED for Street Light Brochure." 8 pages. date: Aug. 2006.
Affineon Lighting, Coral Springs, FL. Excerpts from Affineon Lighting. DL Downlight specification. Copyright 2009.
Affineon Lighting, Coral Springs, FL. Excerpts from Affineon Lighting. DLM Mini Downlight specification. Copyright 2008.
Kramer Lighting, Sturtevant, WI. Excerpts from Kramer Lighting brochure. Metal Halide Cylinder Downlightt specification. Copyright 2010.

(56) References Cited

OTHER PUBLICATIONS

Kramer Lighting, Sturtevant, WI. Excerpts from Kramer Lighting brochure. Quartz Cylinder Downlight specification. Copyright 2010.
Light News. Date: Nov. 2010. 8 pages. Electron AG, Bereich Lichttechnik, Riedhofstrasse 11, CH-8804 Au ZH.
Excerpt from Aavid Thermalloy (www.aavidthermalloy.com). Part Specificiation. 1 page. Date: Copyright 2006.
Philips Lumec, Roadstar Luminaire brochure. 43 pages.
Philips Lumec, Roadstar Series brochure. Date: 2009. 26 pages. Philips Group, Lumec Head Office, 640 Cure-Boivin Boulevard, Boisbriand, Quebec, Canada J7G 2A7.
Philips Roadway Lighting. Product Brochure. Date: Copyright 2010. 12 pages.

* cited by examiner

AR = 3

AR = 2

AR = 1.07

AR = 1.67

AR = 1.22

AERODYNAMIC LED LIGHT FIXTURE

RELATED APPLICATION

This application is a continuation of patent application Ser. No. 11/864,298, filed Sep. 28, 2007. This application is also a continuation-in-part of patent application Ser. No. 13/834,525, filed Mar. 15, 2013, which is a continuation of patent application Ser. No. 13/294,459, filed Nov. 11, 2011, now U.S. Pat. No. 8,425,071, issued Apr. 23, 2013, which is a continuation of patent application Ser. No. 12/629,986, filed Dec. 3, 2009, now U.S. Pat. No. 8,070,306, issued Dec. 6, 2011, which is a continuation of patent application Ser. No. 11/860,887, filed Sep. 25, 2007, now U.S. Pat. No. 7,686,469, issued Mar. 30, 2010, which is a continuation-in-part of now abandoned patent application Ser. No. 11/541,908, filed Sep. 30, 2006. The entire contents of each of the parent applications are incorporated herein by reference.

FIELD OF THE INVENTION

This invention relates to lighting fixtures and, more particularly, to light fixtures using LED modules.

BACKGROUND OF THE INVENTION

In recent years, the use of light-emitting diodes (LEDs) for various common lighting purposes has increased, and this trend has accelerated as advances have been made in LEDs and in LED arrays, often referred to as "LED modules." Indeed, lighting applications which previously had been served by fixtures using what are known as high-intensity discharge (HID) lamps are now beginning to be served by fixtures using LED-array-bearing modules. Such lighting applications include, among a good many others, roadway lighting, factory lighting, parking lot lighting and commercial building lighting.

Work continues in the field of LED module development, and also in the field of using LED modules for various lighting fixtures in various applications. It is the latter field to which this invention relates.

Floodlights using LED modules as light source for various applications present particularly challenging problems in fixture development, particularly when floodlight mounting locations and structures will vary. Lighting-fixture adaptability is an important goal for LED floodlights that are often presented and mounted in different ways.

Heat dissipation is another problem for LED floodlights. And, the goals of dealing with heat dissipation and protection of electronic LED drivers can often be conflicting, contrary goals.

Wind load is another problem for LED floodlights and floodlights that are mounted on poles in general. Calculating wind loads is an important factor in the design of a wind force-resisting system for use in floodlights. This includes the design of fixture structural members and components against wind problems such as overturning and uplift actions.

Streamlined lighting fixtures provide several advantages given their traditional "slim" design. Lighting fixtures that are designed in an aerodynamic fashion not only decrease the wind load that is placed on the fixture but also decrease rattling and other wind-generated disturbances. Some LED floodlights of the prior art are bulky in size. Given their bulky nature these floodlights are very susceptible to wind load damage.

In short, there is a significant need in the lighting industry for improved floodlight fixtures using modular LED units—fixtures that are adaptable for a wide variety of mountings and situations, and that satisfy the problems associated with wind load in all directions. Finally, there is a need for an improved LED-module-based floodlight which is easy and inexpensive to manufacture.

OBJECTS OF THE INVENTION

It is an object of the invention to provide an improved LED floodlight fixture that overcomes some of the problems and shortcomings of the prior art, including those referred to above.

Another object of the invention is to provide an improved LED floodlight fixture that is readily adaptable for a variety of mounting positions and situations.

Another object of the invention is to provide an improved LED floodlight that reduces development and manufacturing costs for LED floodlight for different floodlight applications.

Another object of the invention is to provide an improved LED floodlight with aerodynamic properties subjecting it to less wind load when mounted on a pole or similar mounting.

How these and other objects are accomplished will become apparent from the following descriptions and the drawings.

SUMMARY OF THE INVENTION

The present invention is an improvement in LED floodlight fixtures. The inventive LED floodlight fixture includes two major principal axes in a plane, and the dimensions parallel to its third principal axis are substantially smaller than the largest dimensions parallel to the plane. The fixture is characterized by a first outer surface which has a central portion and a first edge-adjacent portion, an opposite second outer surface which has a light-emitting region and a second edge-adjacent portion. The first and second edge-adjacent portions meet at a perimetrical edge. The central portion and the light-emitting region each extend across at least 50% of the area within the perimetrical edge. The first and second edge-adjacent portions form aerodynamic-drag-reducing cross-sectional profiles transverse to the plane and extend in substantially all in-plane directions. The greatest dimension between the first central portion and the reference plane is no more than 50% greater than the smallest dimension therebetween.

In some highly preferred embodiments, each of the aerodynamic-drag-reducing cross-sectional profiles have an aspect ratio of about 3 or less. It is preferred that the aspect ratio is about 1.25 or less.

In certain preferred embodiments, the cross-sectional profiles are substantially the same. It is preferable that at least one of the edge-adjacent portions is substantially convex. In other preferred embodiments, both the edge-adjacent portions are substantially convex.

In certain preferred embodiments, the LED floodlight fixture includes a pole-mounting assembly which attaches the fixture to a light pole. Such pole-mounting assembly preferably includes a pole-attachment portion for receiving and securing a pole and a substantially water/air-tight section enclosing electrical connections (not shown).

The inventive LED floodlight fixture includes a housing forming a substantially water/air-tight chamber, at least one electronic LED driver enclosed within the chamber, and an LED assembly secured with respect to the housing adjacent thereto in non-water/air-tight condition, the LED assembly having at least one LED-array module mounted on an LED heat sink.

The housing preferably includes substantially water/air-tight wire-access(es) for passage of wires between the LED assembly and the water/air-tight chamber.

The housing includes a first border structure forming a first border-portion of the chamber, the first border structure receiving wires from the at least one LED-array module and the LED heat sink being interlocked with the first border structure. The housing further includes a frame structure forming a frame-portion of the chamber secured to the first border structure, the frame structure extending along the LED assembly. It is highly preferred that the border structure is a metal extrusion.

In some preferred embodiments, the first border structure has at least one bolt-receiving border-hole through the first border structure, such border-hole being isolated from the first border-portion of the chamber. The frame structure also has at least one bolt-receiving frame-hole through the frame structure, the frame-hole being isolated from the frame-portion of the chamber. Each such one or more frame-holes are aligned with a respective border-hole(s). A bolt passes through each aligned pair of bolt-receiving holes such that the border structures and the frame structure are bolted together while maintaining the water/air-tight condition of the chamber.

In some highly preferred embodiments, the housing includes a second border structure forming a second border-portion of the chamber, the LED heat sink being interlocked with the second border structure. In such embodiments, the frame structure is secured to the first and second border structures.

The frame structure preferably includes an opening edge about the frame-portion of the chamber. A removable cover-plate is preferably in substantial water/air-tight sealing engagement with respect to the opening edge. Such opening edge may also have a groove configured for mating water/air-tight engagement with the border structure(s). It is preferred that one or more electronic LED drivers are enclosed in the frame-portion of the chamber.

In certain preferred embodiments the frame structure preferably includes a vent permitting air flow to and from the LED assembly. Such venting facilitates cooling the LED assembly.

In certain highly preferred embodiments of this invention, including those used for street lighting and the like, the housing is a perimetrical structure such that the substantially water/air-tight chamber substantially surrounds the LED assembly. The perimetrical structure is preferably substantially rectangular and includes the first and second border structures and a pair of opposed frame structures each secured to the first and second border structures.

In some versions of the inventive LED floodlight fixture, the housing is a perimetrical structure configured for wall mounting and includes the first and second border structures on opposed perimetrical sides and the frame structure secured on a perimetrical side between the border structures.

In certain highly preferred embodiments of the inventive LED floodlight fixture, the LED assembly includes a plurality of LED-array modules each separately mounted on its corresponding LED heat sink, the LED heat sinks being interconnected to hold the LED-array modules in fixed relative positions. Each heat sink preferably includes a base with a back base-surface, an opposite base-surface, two base-ends and first and second base-sides, a female side-fin and a male side-fin, one along each of the opposite sides and each protruding from the opposite surface to terminate at a distal fin-edge. The female side-fin includes a flange hook positioned to engage the distal fin-edge of the male side-fin of an adjacent heat sink. At least one inner-fin projects from the opposite surface between the side-fins. One of the LED modules is against the back surface.

In some preferred embodiments, each heat sink includes a plurality of inner-fins protruding from the opposite base-surface. Each heat sink may also include first and second lateral supports protruding from the back base-surface, the lateral supports each having an inner portion and an outer portion, the inner portions of the first and second lateral supports having first and second opposed support-ledges, respectively, forming a heat-sink-passageway slidably supporting one of the LED-array modules against the back base-surface. The first and second supports of each heat sink are preferably in substantially planar alignment with the first and second side-fins, respectively. The flange hook is preferably at the distal fin-edge of the first side-fin.

It is highly preferred that each heat sink be a metal extrusion with the back base-surface of such heat sink being substantially flat to facilitate heat transfer from the LED-array module, which itself has a flat surface against the back-base surface.

Each heat sink also preferably includes a lateral recess at the first base-side and a lateral protrusion at the second base-side, the recesses and protrusions being positioned and configured for mating engagement of the protrusion of one heat sink with the recess of the adjacent heat sink.

In certain of the above preferred embodiments, the female and male side-fins are each a continuous wall extending along the first and second base-sides, respectively. It is further preferred that the inner-fins are also each a continuous wall extending along the base. The inner-fins can be substantially parallel to the side-fins.

In highly preferred embodiments, the LED floodlight fixture further includes an interlock of the housing to the LED assembly. The interlock has a slotted cavity extending along the housing and a cavity-engaging coupler which extends from the heat sink of the LED assembly and is received within the slotted cavity.

In some of such preferred embodiments, in each heat sink, at least one of the inner-fins is a middle-fin including a fin-end forming a mounting hole receiving a coupler. In some versions of such embodiments, the coupler has a coupler-head; and the interlock is a slotted cavity engaging the coupler-head within the slotted cavity. The slotted cavity preferably extends along the border structure and the coupler-head extends from the heat sink of the LED assembly.

In preferred embodiments of this invention, the LED floodlight fixture includes a restraining bracket secured to the housing. The bracket has a plurality of projections extending between adjacent pairs of fins of the heat sink, thus to secure the LED assembly. The restraining bracket preferably has a comb-like structure including an elongated body with a spine-portion from which identical side-by-side projections extend in a common plane. Such restraining bracket is configured and dimensioned for the elongated body to be fixedly secured to the housing and the projections to snugly fit in spaces between adjacent heat-sink fins, thus holding heat sink from moving.

The LED floodlight fixture further includes a mounting assembly secured to the housing. The mounting assembly preferably has a pole-attachment portion and a substantially water/air-tight section enclosing electrical connections with at least one wire-aperture communicating with the water/ air-tight chamber. The housing is in water/air-tight engagement with the water/air-tight section of the pole-mounting assembly.

Preferably, the pole-mounting assembly has a mounting plate abutting the LED assembly, and at least one fastener/coupler extends from the mounting plate for engagement with the mounting hole of the middle-fin(s).

In certain embodiments of this invention, including those used for parking-structure lighting and the like, the frame structure is a sole frame structure, and the housing is a substantially H-shaped structure with the sole frame structure secured between mid-length positions of the pair of opposed border structures.

Some of the inventive LED floodlight fixtures include a protective cover extending over the LED assembly and secured with respect to the housing. Such protective cover preferably has perforations permitting air/water-flow therethrough for access to and from the LED assembly.

It is most highly preferred that the LED floodlight fixture has a venting gap between the housing and the LED assembly to permit water/air-flow from the heat sink. The venting gap may be formed by the interlock of the housing to the LED assembly.

The improved LED floodlight fixture of this invention overcomes the problems discussed above. Among other things, the invention is both adaptable for varying applications and mountings, and given the aerodynamic features of the invention, it is not adversely affected by wind flowing past it (wind loads).

As used herein, the term "principal axes" refers to a set of mutually-perpendicular axes characterized by the following: (1) the origin of the axes is located generally centrally within the volume of the floodlight fixture; (2) a first axis is aligned with the largest dimension of the fixture; (3) a second axis is aligned with the largest dimension perpendicular to the first axis; and (4) the remaining (third) axis defines a direction in which thickness of the fixture is defined. The first and second axes as defined above together define a plane P, and fixture thickness is measured perpendicular to plane P. A simple graphical explanation of principal axes is shown in FIGS. 5 and 7, and the drawings illustrate fixture plane in perspective with lines 48, 50 both residing in fixture plane as illustrated in FIG. 1. Also as shown in FIG. 1, the perimetrical edge resides in the fixture plane.

As used herein, the term "aspect ratio" as applied to the aerodynamic-drag-reducing profiles formed by the first and second edge-adjacent portions of the floodlight fixture is the ratio of the maximum dimension $d_3$ as defined of the profile in a direction parallel to the third axis as defined above to the maximum dimension $d_P$ of the profile in plane P as defined above. For an illustration of aspect ratio AR ($AR=d_3/d_P$) refer to FIGS. 8A-8E.

As used herein, the term "substantially convex" as applied to the aerodynamic-drag-reducing profiles refers to the shape of a portion of the profile as viewed from outside the fixture. A portion of the profile is substantially convex if all but small regions of the portion are convex, the small regions having locally non-convex portions to enable fastening or stiffening of the edge-adjacent portions. Such non-convex portions constitute less than 20% of the surface area of an edge-adjacent portion having substantially-convex profiles. The most preferred profile portions are generally smooth and convex everywhere along the profile portion.

As used herein, the term "encompassing" as applied to the second central portion encompassing the light-emitting region includes fixture configurations in which the light-emitting region has an area smaller than the second central portion as well as fixture configurations in which the light-emitting region has substantially the same area as the second central portion.

As used herein, the term "perimetrical structure" means an outer portion of the fixture which completely or partially surrounds remaining portions of the fixture. In certain preferred embodiments, such as those most useful for road-way lighting and the like, the perimetrical structure preferably completely surrounds remaining portions of the fixture. In certain other cases, such as certain wall-mounted floodlight fixtures, the perimetrical structure partially surrounds the remaining portions of the fixture.

The profile of an edge-adjacent portion of the floodlight fixture is considered to be aerodynamic-drag-reducing based on the fact that the aerodynamic drag forces (forces parallel to plane P) on the floodlight fixture from wind striking the fixture generally in plane P will be less than the drag forces which would be generated if the profile were simply a flat surface perpendicular to plane P and spanning the distance between the two boundaries of the two edge-adjacent portions as described above.

DETAILED DESCRIPTION OF PREFERRED EMBODIMENTS

Figure 5:
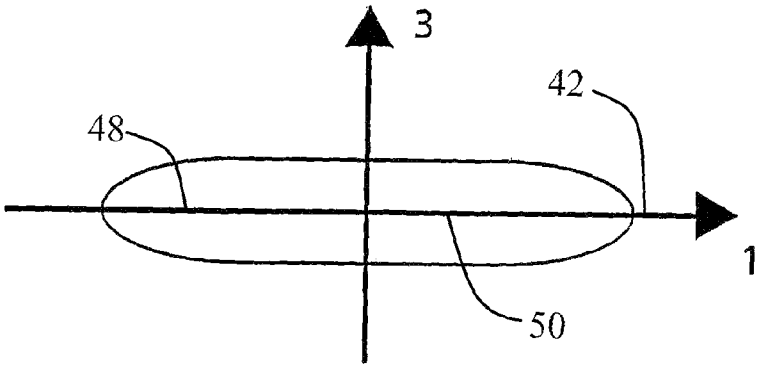
FIG. 5 illustrates the first major principal axes and the third principal axis of the LED floodlight fixture of FIG. 1.
Figure 6:
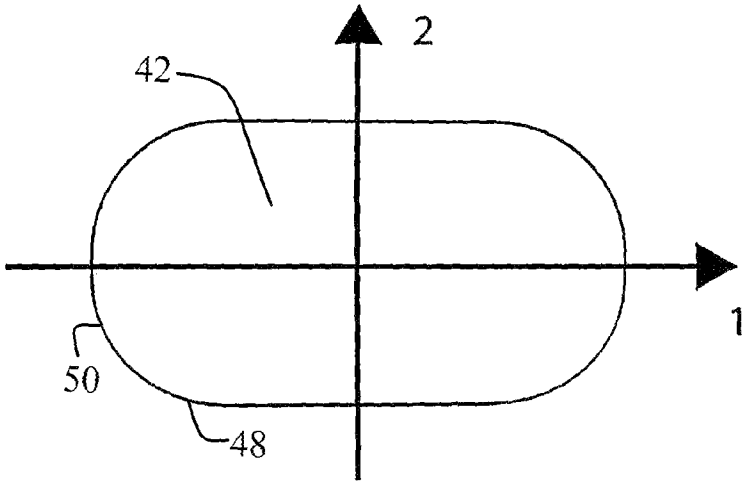
FIG. 6 illustrates the two major principal axes of the LED floodlight fixture of FIG. 1.
Figure 7:
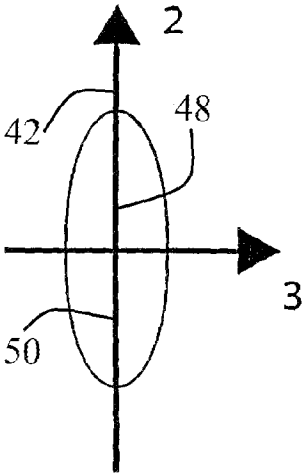
FIG. 7 illustrates the second major principal axis and the third minor principal axis of the LED floodlight fixture of FIG. 1.
Figure 8A:
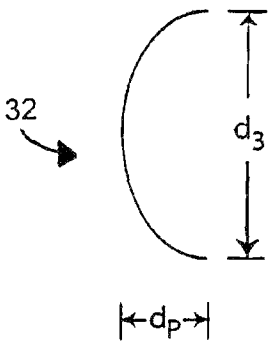
FIGS. 8A-8E illustrate various aerodynamic-drag-reducing cross-sectional profiles.
Figure 8B:
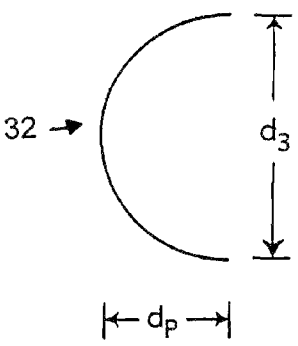
Figure 8C:
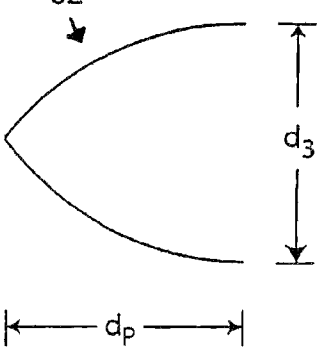
Figure 8D:
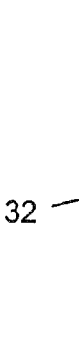
Figure 8E:
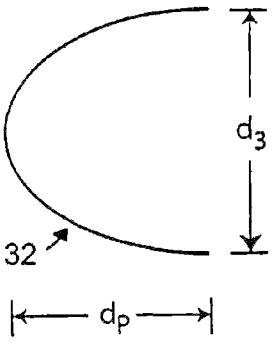

FIGS. 1-4 illustrate a preferred LED floodlight fixture in accordance with this invention. LED floodlight fixture 10 includes two major principal axes (illustrated in FIGS. 5-7 as 1, 2) in a fixture plane 42 (illustrated in FIG. 1). The dimensions parallel to its third principal axis (illustrated in FIGS. 7 and 8 as 3) are substantially smaller than the largest dimensions parallel to fixture plane 42. A simple graphical explanation of the three principal axes (1-3) is shown in FIGS. 5-7.

Figure 1:
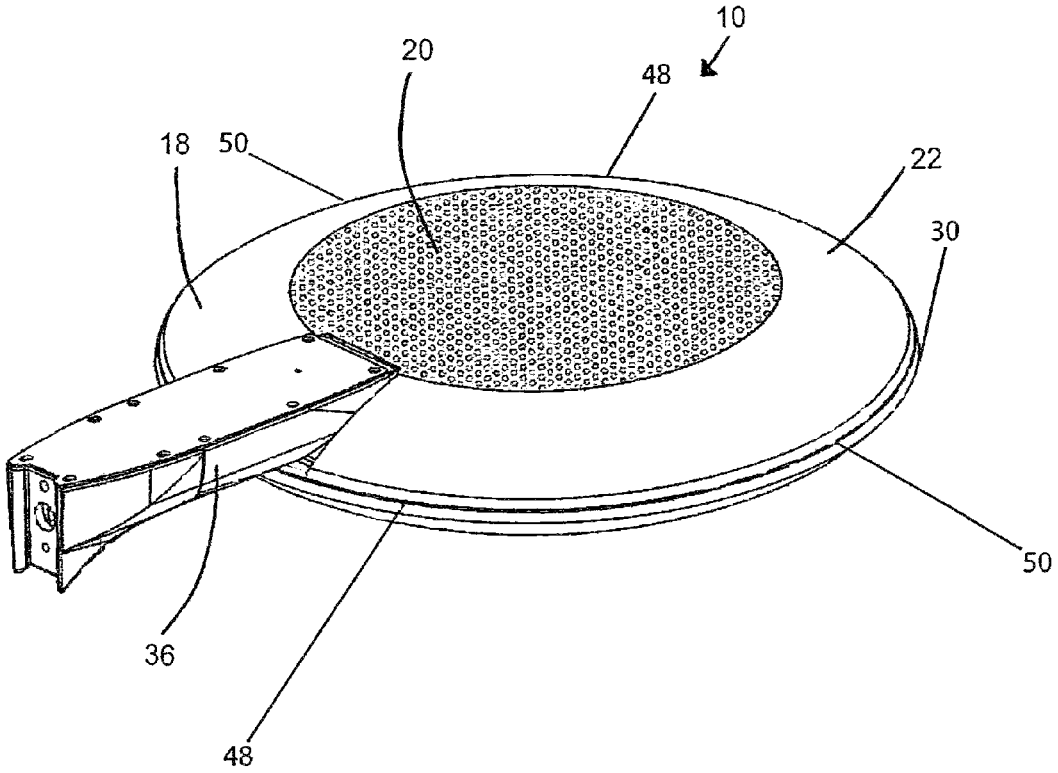
FIG. 1 is a perspective view of a preferred LED floodlight fixture in accordance with this invention configured for mounting on a pole.
Figure 2:
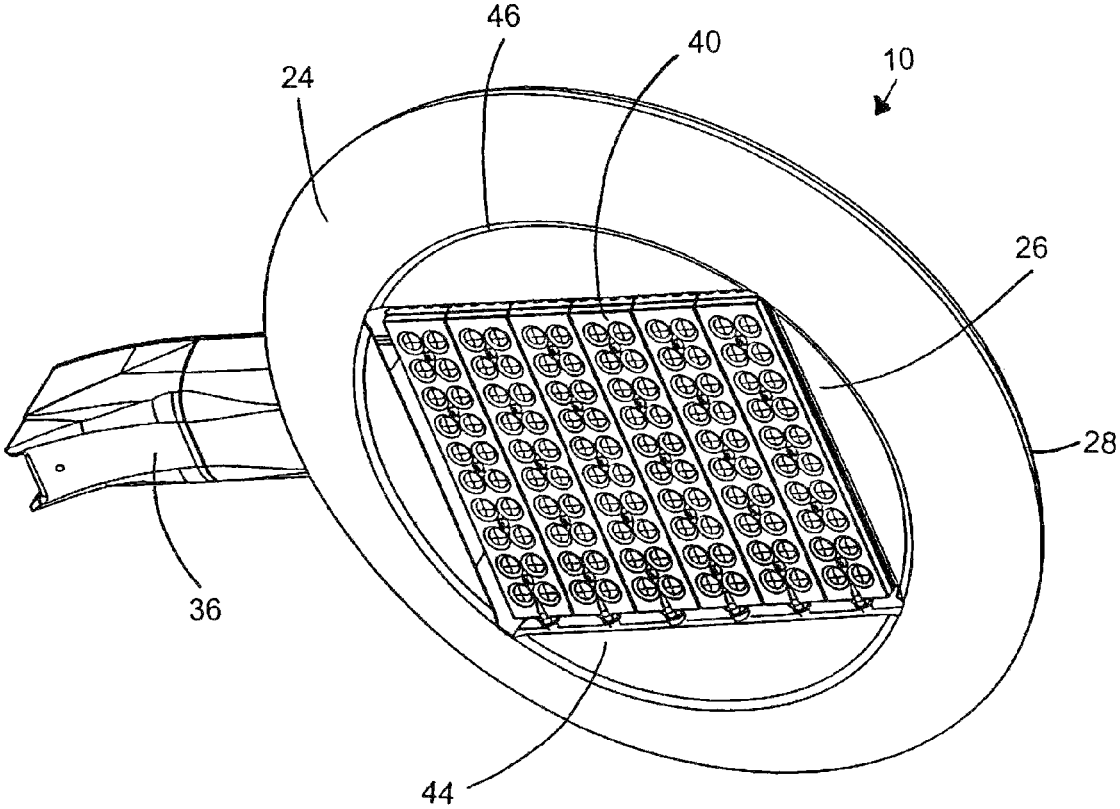
FIG. 2 is a perspective view of the LED floodlight fixture of FIG. 1.
Figure 3:
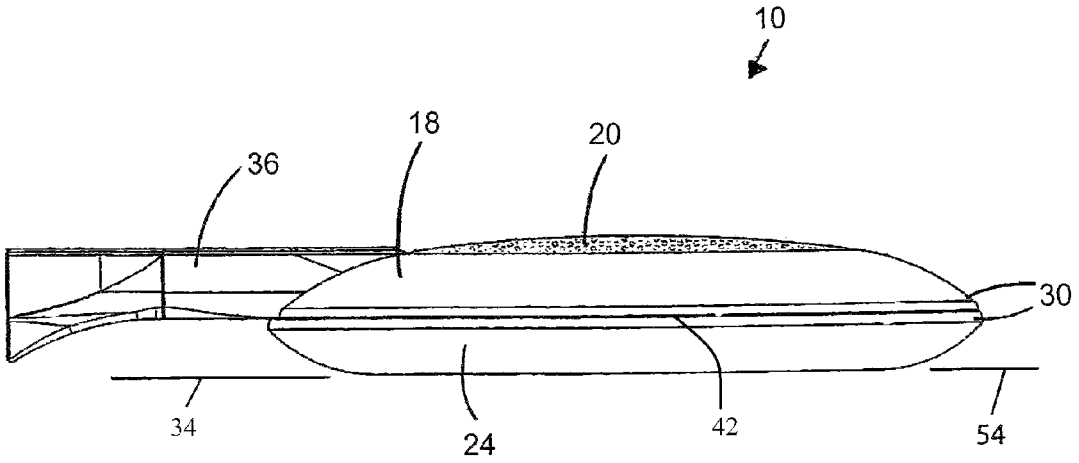
FIG. 3 is a side perspective view of the LED floodlight fixture of FIG. 1 including a pole-mounting assembly and a reference plane.

As best seen in FIGS. 1-3, fixture 10 is characterized by a first outer surface 18 having a first central portion 20 and a first edge-adjacent portion 22, an opposite second outer surface 24 having a second central portion 44 substantially aligned with first central portion 20 and encompassing a light-emitting region 26. Second outer surface 24 also includes a second edge-adjacent portion 28 having a boundary 46 with second central portion 44, such boundary 46 defining a reference plane 34. Reference plane 34 is shown in FIG. 3 as indicated by line 54 with reference plane 34 being perpendicular to the page and containing line 54. Boundary 46 resides in reference plane 34. A simple graphical explanation of principal axes is shown in FIGS. 5 and 7, the drawings illustrate fixture plane 42 in perspective with lines 48, 50 both residing in plane 42 as illustrated in FIG. 1. Also as shown in FIG. 1, perimetrical edge 30 resides in fixture plane 42.

First and second edge-adjacent portions 22, 28 meet a perimetrical edge 30 as illustrated in FIG. 3. As shown in FIGS. 1-3, first and second central portions 20, 44 each extend across at least 25% of the area within perimetrical edge 30. First and second edge-adjacent portions 22, 28 form aerodynamic-drag-reducing cross-sectional profiles 32 transverse to fixture-plane 42 and extend in substantially all in-fixture-plane 42 directions and have aspect ratios of about 3 or less.

Various examples of aerodynamic-drag-reducing cross-sectional profiles 32 are illustrated in FIGS. 8A-8E. FIGS. 8A-8E illustrate that each of the aerodynamic-drag-reducing cross-sectional profiles 32 have an aspect ratio (AR) of about 3 or less. Aspect ration AR as defined above is equal to $d_3/d_P$, and each of the FIGS. 8A-8E indicate these dimensions and a corresponding aspect ratio. All of the profiles illustrated in FIGS. 8A-8E are aerodynamic-drag-reducing cross-sectional profiles 32. Those skilled in the art of aerodynamics will appreciate that certain shapes have lower drag than others and that the aspect ratio is a primary determinant of the aerodynamic drag of a profile. Thus typically, lower aspect ratios are accompanied by lower drag.

As seen in FIGS. 1-3, the greatest dimension between first central portion 20 and reference plane 34 is no more than 50% greater than the smallest dimension therebetween. Second central portion 44 as illustrated in FIG. 2, can consist of 100% opening but can be also less than 100% opening. Second central portion 44 can also be inset into LED floodlight fixture 10.

As shown in FIG. 1, cross-sectional profiles 32 of fixture 10 are substantially the same. In some embodiments, at least one of first or second edge-adjacent portions 22, 28 is substantially convex. In alternate embodiments both first and second edge-adjacent portions 22, 28 are substantially convex but all of the profiles around the alternate embodiment are not the same. The maximum dimension between first and second edge-adjacent portions 22, 28 in a direction perpendicular to fixture plane 42 occurs between a boundary 52 of first edge-adjacent portion 22 and first central portion 20 and reference plane 34 as seen in FIGS. 1-3.

Figure 4:
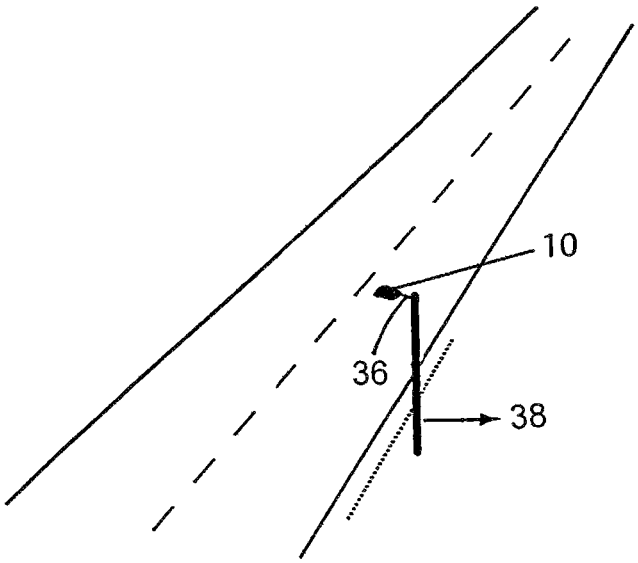
FIG. 4 is a perspective view of the LED floodlight fixture of FIG. 1 mounted to a light pole.

In certain preferred embodiments as shown in FIG. 4, LED floodlight fixture 10 includes pole-mounting assembly 36 which attaches fixture 10 to light pole 38. LED floodlight fixture 10 includes a plurality of LED-array modules 40 fixed in relative positions. Preferably, the pole-mounting assembly 36 has a mounting plate abutting the LED assembly, and at least one fastener/coupler extends from the mounting plate for engagement with the mounting hole of the middle-fin(s) (not shown).

A wide variety of materials are available for the various parts discussed and illustrated herein. While the principles of this invention have been described in connection with specific embodiments, it should be understood clearly that these descriptions are made only by way of example and are not intended to limit the scope of the invention.

The invention claimed is:

1. An LED light fixture comprising:

two major principal axes in a fixture plane, the dimensions of the fixture in planes parallel to its third principal axis being substantially smaller than the largest dimensions parallel to the fixture plane;

a first outer side having a first central portion;

an opposite second outer side having a second central portion substantially aligned with the first central portion and encompassing a light-emitting region open to air and water flow and including at least one LED-array module supported by an LED heat sink; and a perimetrical structure forming a closed chamber which fully surrounds the light-emitting region and encloses at least one electronic LED driver, the perimetrical structure having first and second edge-adjacent portions meeting at a perimetrical edge and each having a boundary with the respective one of the first and second central portions, the first and second edge-adjacent portions converging toward each other at positions progressively closer to the perimetrical edge, thereby forming aerodynamic-drag-reducing cross-sectional profiles transverse to the fixture plane and extending in substantially all fixture-plane directions from the intersection of its two major principal axes.

2. The LED light fixture of claim 1 wherein the first and second edge-adjacent portions together have aspect ratios of about 3 or less.

3. The LED light fixture of claim 1 wherein the cross-sectional profiles in substantially all planes containing the third principal axis are substantially the same.

4. The LED light fixture of claim 1 wherein at least one of the edge-adjacent portions is substantially convex.

5. The LED light fixture of claim 4 wherein both the edge-adjacent portions are substantially convex.

6. The LED light fixture of claim 1 wherein the boundary between the second central and edge-adjacent portions define a reference plane; and the maximum dimension between the first and second edge-adjacent portions in a direction perpendicular to the fixture plane occurs between the reference plane and the boundary of the first edge-adjacent portion and the first central portion.

7. The LED light fixture of claim 1 further including a pole-mounting assembly which attaches the fixture to a light pole.

8. The LED light fixture of claim 1 wherein the light-emitting region permits air and water flow therethrough between the at least one LED-array module and the chamber.

9. The LED light fixture of claim 1 wherein the largest dimensions of the fixture in the plane of the two largest principal axes are substantially equal.

10. The LED light fixture of claim 9 wherein the cross-section in the plane of the two largest principal axes is substantially circular.

11. The LED light fixture of claim 10 wherein the cross-sectional profiles in substantially all planes containing the third principal axes are substantially the same.

12. The LED light fixture of claim 1 wherein the edge-adjacent portions are each convex.

13. An LED light fixture comprising:

a light-emitting region open for air and water flow and including at least one LED-array module supported by an LED heat sink; and a perimetrical structure forming a closed chamber which fully surrounds the light-emitting region and encloses at least one electronic LED driver, the perimetrical structure having first and second opposite substantially-aligned edge-adjacent portions each having a boundary with the light-emitting region and meeting each other at a perimetrical edge, the first and second edge-adjacent portions converging toward each other at positions progressively closer to the perimetrical edge to form aerodynamic-drag-reducing cross-sectional profiles transverse to the fixture plane and extending in substantially all fixture-plane directions from the intersection of its two major principal axes.

14. The LED light fixture of claim 13 wherein the light-emitting region extends across at least 25% of an area within the perimetrical edge.

15. The LED light fixture of claim 13 wherein at least one of the edge-adjacent portions is substantially convex.

16. An LED light fixture comprising:

a light-emitting region open for air and water flow and including at least one LED-array module supported by an LED heat sink; and a perimetrical structure forming a closed chamber which fully surrounds the light-emitting region and encloses at least one electronic LED driver, the perimetrical structure having first and second opposite substantially-aligned edge-adjacent portions each having a boundary with the light-emitting region and meeting each other at a perimetrical edge, the perimetrical structure permitting air and water flow to and from the LED heat sink, the first and second edge-adjacent portions converging toward each other at positions progressively closer to the perimetrical edge to form aerodynamic-drag-reducing cross-sectional profiles transverse to the fixture plane and extending in substantially all fixture-plane directions from the intersection of its two major principal axes.

17. The LED light fixture of claim 16 wherein the cross-sectional profiles in substantially all planes containing the third principal axis are substantially the same.

18. A pole-mounted light fixture comprising:

two major principal axes in a fixture plane, the dimensions of the fixture in planes parallel to its third principal axis being substantially smaller than the largest dimensions parallel to the fixture plane;

a first outer side comprising a first central portion and a first edge-adjacent portion;

an opposite second outer side comprising (a) a second central portion substantially aligned with the first central portion and encompassing a light-emitting region which is open for air and water flow and includes at least one LED-array module supported by an LED heat sink, and (b) a second edge-adjacent portion having a boundary with the second central portion, the boundary defining a reference plane;

at least one electronic LED driver enclosed within a closed chamber which fully surrounds the light-emitting region and is formed by the first and second edge-adjacent portions each having a boundary with the light-emitting region and converging toward each other at positions progressively closer to the perimetrical edge to form aerodynamic-drag-reducing cross-sectional profiles transverse to the fixture plane and extending in substantially all fixture-plane directions from the intersection of its two major principal axes; and the greatest distance perpendicular to the fixture plane between the first central portion and the reference plane is no more than 50% greater than the smallest distance therebetween.

19. The LED light fixture of claim 18 wherein the aerodynamic-drag-reducing cross-sectional profiles extend in substantially all fixture-plane directions from the intersection of its two major principal axes.

20. The LED light fixture of claim 18 wherein the first and second edge-adjacent portions together have aspect ratios of about 1.25 or less.

* * * * *